US006027374A

United States Patent [19]

Nagai et al.

[11] Patent Number: 6,027,374

[45] Date of Patent: Feb. 22, 2000

[54] ELECTRICAL CONNECTOR WITH HINGED COVER FOR A VEHICLE SIDE FITTING PANEL

[75] Inventors: Kentaro Nagai; Tetsuya Yamashita, both of Shizuoka, Japan

[73] Assignee: Yazaki Corporation, Tokyo, Japan

[21] Appl. No.: 09/175,976

[22] Filed: Oct. 21, 1998

[30] Foreign Application Priority Data

Oct. 22, 1997 [JP] Japan ..... 9-290009

[51] Int. Cl.[7] ..... H01R 13/40

[52] U.S. Cl. ..... 439/596; 439/752

[58] Field of Search ..... 439/596, 752, 439/575, 404, 409, 417, 467

[56] References Cited

U.S. PATENT DOCUMENTS

| | | | |
|---|---|---|---|
| 5,697,819 | 12/1997 | Hatagishi | 439/752 |
| 5,713,756 | 2/1998 | Abe | 439/404 |
| 5,779,506 | 7/1998 | Okabe et al. | 439/752 |

FOREIGN PATENT DOCUMENTS 9-199211 7/1997 Japan .

*Primary Examiner*—Paula Bradley
*Assistant Examiner*—Tho D. Ta
*Attorney, Agent, or Firm*—Armstrong, Westerman, Hattori, McLeland & Naughton

[57] ABSTRACT

A connector housing has a terminal receiving portion at its rear side and an opposing connector coupling portion at its fore side. The terminal receiving portion includes a plurality of the terminal receiving channels separated by a plurality of partition walls extending in the connector engagement direction and each side wall is provided with a locking projection. The opposing connector coupling portion has a guide wall member that defines an insertion cavity for receiving a vehicle side fitting member. One of a plurality of wire-press-fit-type terminals is received in each of the terminal receiving channels for press-fitting an electrical wire therein. The terminal receiving portion has a cover, with a fore end of the cover being attached to the connector housing with a hinge, and each side wall of the cover has a lock hook that is engaged with one of the locking projections. The guide wall member has a cut-out recess for receiving a fore end portion of the cover and the lock hook of the cover engages with the locking projection of the connector housing when the cover closes the terminal receiving portion. The insertion cavity of the connector housing receives the vehicle side fitting member so that the fitting member abuts against the cover to further secure the cover to the connector housing.

6 Claims, 5 Drawing Sheets

ELECTRICAL CONNECTOR WITH HINGED COVER FOR A VEHICLE SIDE FITTING PANEL

BACKGROUND OF THE INVENTION

1. Field of the Invention

The present invention relates to a connector having a hinged cover to hold terminals, particularly to a structure for securing the cover to the housing of the connector. The connector housing receives a plurality of terminals each for pressing in an electrical wire and has a construction to be attached to a vehicle side fitting panel.

2. Prior Art

Referring to FIG. 7, there is disclosed a prior art connector 1 that is attached to a vehicle side fitting panel. The connector 1 has a connector housing 2, a plurality of wire-press-fit-type terminals 3 received in the connector housing 2, and a cover 4 engaged with the connector housing 2 for covering the terminals 3.

The connector housing 2 has a plurality of the partition walls 8 provided between a pair of side walls 7, 7 that each have a locking projection 6 (only one of projections 6 is illustrated in the figure) near the rear end 5 of the connector housing 2. The partition walls 8 extend in the insertion direction of the terminals 3 from the rear end 5 to define a terminal receiving portion 10 having a plurality of the terminal receiving channels 9. Joined to the terminal receiving portion 10, is an opposing connector coupling portion 12 which extends to the fore end 11 of the connector housing 2 for mating with an opposing connector housing (not shown). The opposing connector coupling portion 12 has a guide wall member 13 opened toward the terminal receiving channels 9. The guide wall member 13 defines an insertion cavity 15 for receiving a vehicle side fitting panel 14.

The terminal 3 has an electrical connection pin 3*a* extending into the opposing connector coupling portion 12 and an electrical wire crimping portion 3*b* for press-securing an electrical wire 16. The terminal 3 also has a flexible locking tab (lance) 3*c* located in the rear side of the electrical connection pin 3*a* for locking to a stepped portion (not shown) of the terminal receiving channel 9 to secure the terminal 3 in the terminal receiving channel 9.

The cover 4 has a fore end 17 with a pair of hinges 18, 18 that connect the cover 4 to the connector housing 2. Furthermore, the cover 4 has each side wall located near the rear end 19 of the cover 4. Each side wall defines a locking plate 20 having a locking hole 20*a* associated with the locking projection 6.

The connector 1 can receive and secure a plurality of the terminals 3, which each have been press-fitted with the electrical wire 16, in the plurality of terminal receiving channels 9. The locking plate 20 of the cover 4 engages with the locking projection 6 of the connector housing 2 to close the cover 4. The connector 1 is attached to the vehicle side fitting panel 14 that is received into the panel insertion cavity 15.

In the prior art, when the cover 4 has closed the terminal receiving portion 10, the fore end 17 of the cover 4 tends to move upward. The movement of the fore end 17 possibly causes a deformation or a damage of the locking plates 20, 20. The provision of the connector 1 in such an incomplete condition causes a disadvantage to a worker in a car assembling factory where the connector 1 will be attached to a vehicle body with the fitting panel 14.

To eliminate the above-described problem, an object of the present invention is to provide a connector having a terminal receiving portion with a cover that can reliably engage with the connector housing to protect the terminal receiving portion.

SUMMARY OF THE INVENTION

For achieving the object, a first basic configuration of the present invention is an electrical connector comprising:

a connector housing having a terminal receiving portion at its rear side and an opposing connector coupling portion at its fore side, the terminal receiving portion including a pair of side walls and a plurality of terminal receiving channels separated by a plurality of partition walls extending in the connector engagement direction between the side walls, the side walls each having a locking projection, the opposing connector coupling portion having a guide wall member that defines an insertion cavity for receiving a vehicle side fitting member, the guide wall member formed with a cut-out recess, a plurality of wire-press-fit-type terminals each received in one of the terminal receiving channels and each fitted with an electrical wire therein, and a cover for the terminal receiving portion, a fore end of the cover attached to the connector housing with a hinge, the cover having a pair of side walls at its rear portion, the side walls each provided with a lock hook that is engaged with one of the locking projections, wherein, the cut-out recess of the guide wall member receives a fore end portion of the cover and the lock hook of the cover engages with the locking projection of the connector housing when the cover closes the terminal receiving portion.

Thus, in the first configuration, the cut-out recess of the guide wall member receives the fore end portion of the cover and the lock hook of the cover engages with the locking projection of the connector housing, so that the cover doses the terminal receiving portion. Consequently, the fore end of the cover does not move upward when the cover is closed, allowing a reliable protection of the terminals with the cover. Moreover, this prevents a deformation or a damage of the lock hook of the cover and causes no disadvantage to a worker in a car assembling factory where the connector will be attached to a vehicle body with the fitting member. In addition, the terminals are secured by the cover that is held both at the fore end and at the lock hook, which is preferable in the strength of the cover for securing the terminals.

According to a second configuration of the present invention, the connector further includes the feature that the insertion cavity of the connector housing receives the vehicle side fitting member so that the fitting member abuts against the cover to additionally secure the cover to the connector housing.

The second configuration enables the additional press-securing of the cover fore end with the vehicle side fitting member, so that the terminal can be reliably secured and protected by the cover.

According to a third configuration of the present invention, the connector further includes the feature that the locking projection of the connector housing has a tapered surface while the lock hook has an auxiliary lock projection opposing to the tapered surface for locking the lock hook of the cover to the connector housing with no gap.

Thus, in the third configuration, the dosing of the cover against the terminal receiving portion engages the locking projection with the lock hook, and the auxiliary lock projection abuts against the tapered surface, so that the cover engages with the connector housing without a play gap. Thereby, the terminals are further reliably protected in the connector housing.

According to a fourth configuration of the present invention, the connector further includes the feature that the cover has an inner wall provided with a terminal securing portion that is opposed to the terminal receiving portion.

Thus, in the fourth configuration, the closed cover causes the terminal securing portion to abut against the terminal to restrict the movement of the terminal. That is, the closed cover that is prevented from moving upwardly and protects the terminal and stops it in the connector housing.

According to a fifth configuration of the present invention, the connector further includes the feature that the terminal securing portion has a press-securing elongated projection for preventing disengagement of the terminal and for press-securing the electrical wire, and has a cradle for press-securing a crimped portion of an insulated coated part of the electrical wire.

Thus, in the fifth configuration, the combination of the press-securing elongated projection and the press-securing cradle holds and straps the terminals sufficiently.

According to a sixth configuration of the present invention, the connector further includes the feature that the cover has a protrusion at its fore portion for abutting against the vehicle side fitting member.

In the sixth configuration, the protrusion of the cover enables securing of the cover fore end more surely.

DETAILED DESCRIPTION OF THE PREFERRED EMBODIMENTS

Figure 1:
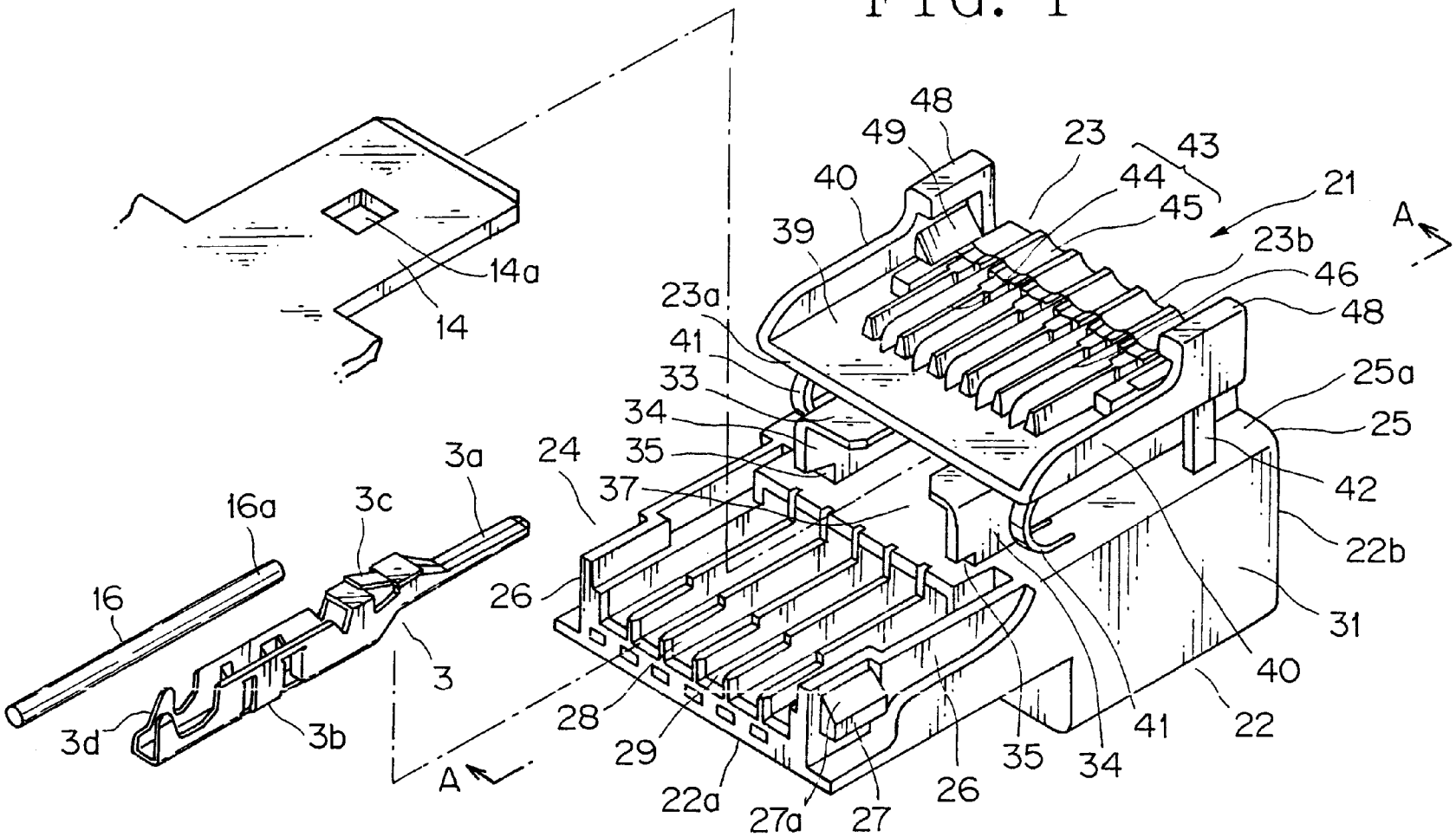
FIG. 1 is an exploded perspective view showing an embodiment of a connector with a cover according to the present invention.

Referring to the accompanied drawings, an embodiment of the present invention will be discussed. Since some of the same reference numerals in the drawings as those in the prior art show the same components, such will not be discussed in detail again.

Referring to FIG. 1, denoted 21 is a connector that has a connector housing 22, a plurality of the terminals 3 that will be received in the connector housing 22, a cover 23 for dosing the connector housing 22 to protect the terminals 3, etc. The connector will be attached to a vehicle side fitting member 14.

The connector housing 22 is made of a synthetic resin material by injection molding. The connector housing 22 has a terminal receiving portion 24 toward its rear end 22*a* and has an opposing connector coupling portion 25 adjacent to the terminal receiving portion 24 toward its fore end 22*b*.

In the outside of the terminal receiving portions 24, the connector housing 22 has each side wall 26 provided with a pair of locking projections 27, 27 (only one of them is illustrated) toward the rear end 22*a* into which the terminals 3 are inserted. Each locking projection 27 has a tapered surface 27*a*. Between the side walls 26, 26, there are provided a plurality of partition walls 28 (five in the figure) extending inwardly from the rear end 22*a*. The partition walls 28 define parallel aligned terminal receiving channels 29. Each terminal receiving channel 29 continues to one of a plurality of insertion through holes 30 formed in the opposing connector coupling portion 25 for accommodating one of the terminals 3 (see FIG. 2).

The opposing connector coupling portion 25 has a hood 31 for receiving an opposing connector housing (not shown). The hood 31 has a locking projection 32 (see FIG. 2) for locking the opposing connector housing.

The opposing connector coupling portion 25 also has a top wall 25*a* provided with a guide wall member 33 for receiving the vehicle side fitting panel 14. The guide wall member 33 has a pair of side walls 34, 34 that each are provided with a cut-out recess 35 associated with the cover 23 and opened toward the terminal receiving portion 24 at a lower part of the side wall. The guide wall member 33 defines a panel insertion cavity 37 for receiving the vehicle side fitting panel 14. The guide wall member 33 has a lock protrusion 36 for locking the fitting panel 14 (see FIG. 2).

Figure 2:
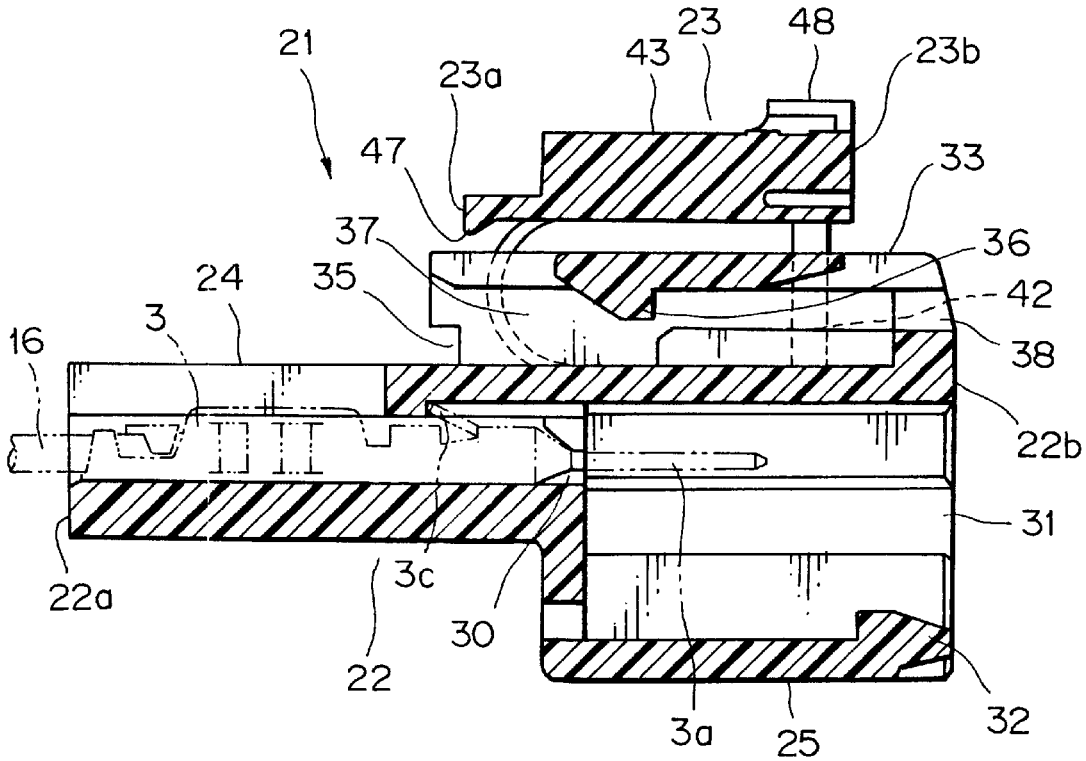
FIG. 2 is a section view taken along line A—A of in FIG. 1.

In addition, denoted 38 is a though hole for injection molding (see FIG. 2). The through hole can be a set hole for positioning a fore end of the vehicle side fitting panel 14.

The cover 23 has a cover plate wall 39 and a pair of side walls 40, 40. The cover 23 connects at a forward portion 23*a* thereof to the connector housing 22 with a pair of hinges 41, 41. Furthermore, the cover 23 is provisionally secured to the connector housing 22 at a rear portion 23*b* thereof with a pair of bands 42, 42 (only one of them is illustrated). The bands 42, 42 are provided for an advantageous molding step of the cover 23 and will be cut off before assembling the connector 21 as described later.

The cover wall plate 39 has a plurality of terminal securing portions 43 that oppose to the terminal receiving portion 24 for securing each terminal 3. The terminal securing portions 43 prevent disengagement of each terminal 3. Moreover, each terminal securing portion 43 has a press-securing elongated projection 44 for securing an electrical wire 16, and has a press-securing cradle 45 for press-securing a crimped portion 3*d* (described later) in a coated insulated part (described later) of the wire 16. The cooperation of the press-securing elongated projection 44 and the press-securing cradle 45 allows the sure holding and lamping of the associated terminal 3. Denoted 46 is a partition wall associated with one of the partition walls 28 of the terminal receiving portion 24.

The cover 23 has a protrusion 47 (see FIG. 2) at its fore end 23*a* for engaging with the cut-out recesses 35, 35 with no gap therebetween. Furthermore, the cover 23 has a pair of lock hooks 48, 48 each at a rear end portion of the side wall 40 for locking each locking projection 27. The lock hook 48 is an L-shaped frame the leading end of which is extending forward. Near the lock hook 48, there are provided a pair of auxiliary lock projections 49, 49 (only one of them is illustrated) associated with the tapered surfaces 27*a*, 27*a* of the locking projections 27, 27 for restricting the movement of the cover 23 after the engagement of the lock hooks 48, 48.

The frame-shaped lock hook 48 may be replaced by plate-shaped one having a locking hole associated with the locking projection 27.

The terminal 3 has a construction similar to one that has been discussed in the prior art. The terminal 3 has an electrical connection pin 3*a* and an electrical wire crimping portion 3*b* for press-securing the electrical wire 16. The terminal 3 also has a flexible locking tab (lance) 3*c* located in the rear side of the electrical connection pin 3*a*. The electrical wire crimping portion 3*b* includes a crimping portion 3*d* for crimping a coated insulated part 16*a* of the electrical wire 16.

The vehicle side fitting panel 14 has the same construction as one shown in the prior art. The panel 14 is extending from the vehicle body and has a locking rectangular hole 14*a* in the middle thereof for engaging with the above-mentioned lock protrusion 36.

Referring to FIGS. 1 to 5, assembling steps of the connector 21 having the above-mentioned structure will be discussed.

First, into each terminal receiving channel 29 of the terminal receiving portion 24, the electrical connection pin 3*a* of one of the terminals 3 is inserted. The terminal 3 is provisionally stopped by the flexible locking tab (lance) 3*c* that resiliently abuts against the stopping stepped portion of the connector housing. The electrical connection pin 3*a* extends in the hood 31 to couple with a receptacle terminal of the opposing connector (not shown). Next, an electrical wire 16 is forced into each terminal 3. The bands 42, 42 connecting the connector housing 22 with the cover 23 (see FIGS. 1 and 2) is appropriately cut so that the cover 23 will be able to dose the terminal receiving portion 24 of the connector housing 22.

Figure 3:
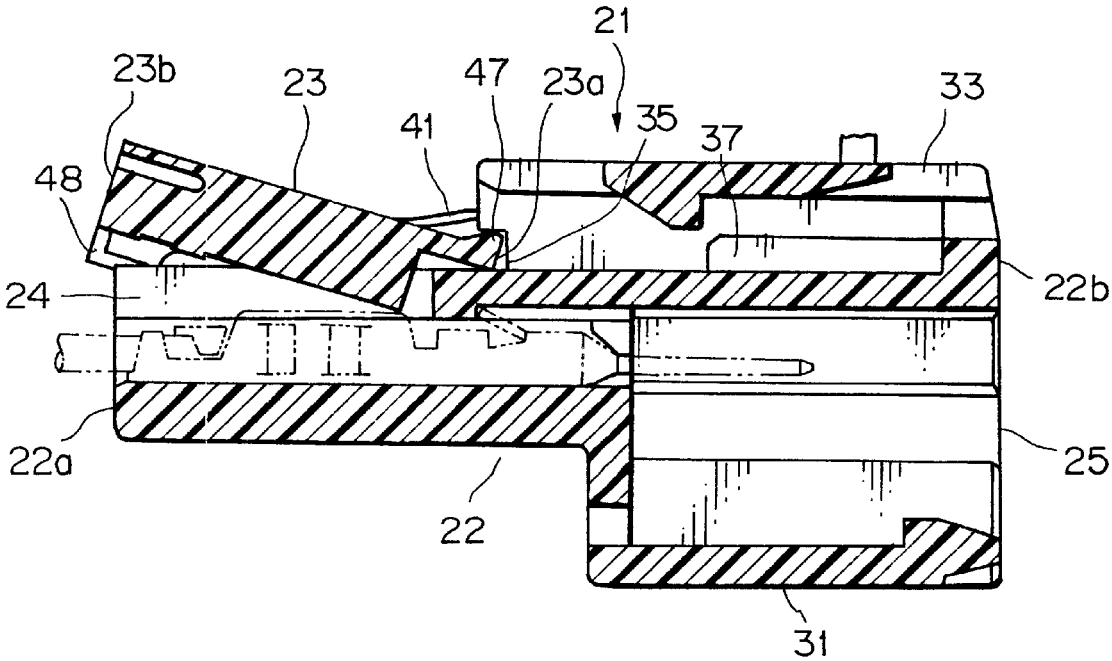
FIG. 3 is a section view of the connector for showing a state in which the cover is going to close a terminal receiving portion of the connector.

Then, as shown in FIG. 3, the fore end 23*a* of the cover 23 slides into the cut-out recesses 35 of the guide wall member 33. Around the protrusion 47, the cover 23 pivots toward the terminal receiving portion 24, so that protrusion 47 resiliently deforms slightly to stably engage with the cut-out recesses 35.

Figure 4:
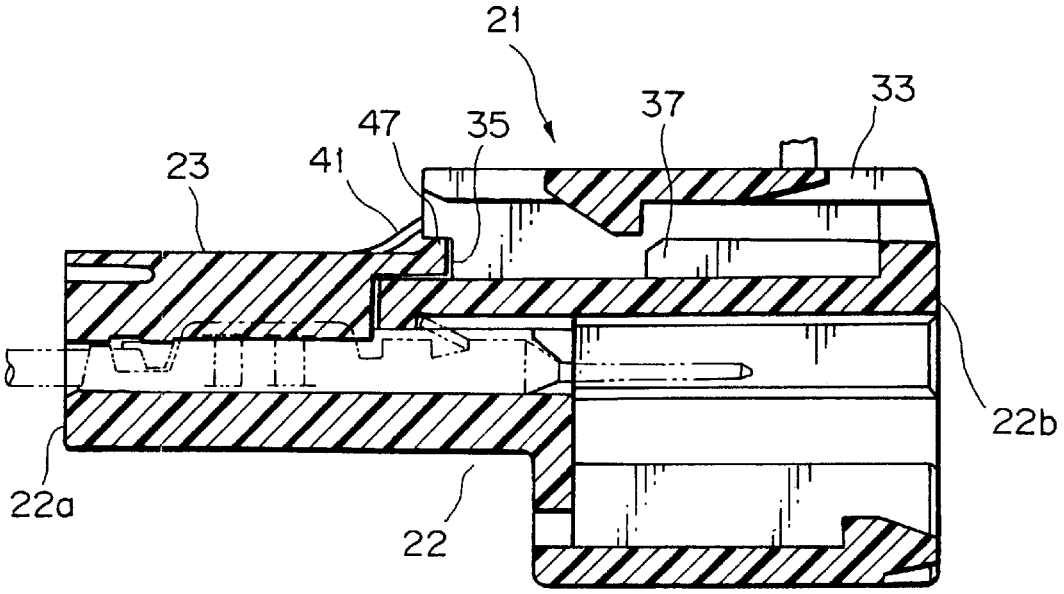
FIG. 4 is a section view of the connector for showing the state that the cover has closed the terminal receiving portion to complete the connector.
Figure 5:
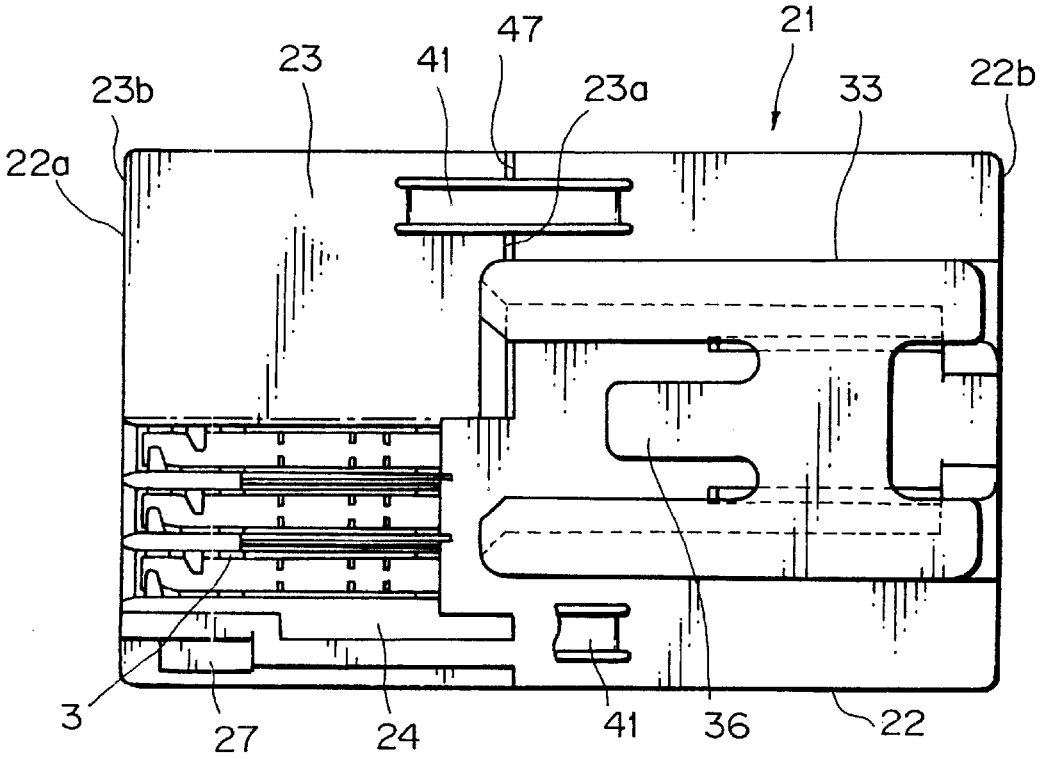
FIG. 5 is a plan view corresponding to FIG. 4.

At the same time, the lock hook 48 of the cover 23 locks to the locking projection 27 (see FIG. 1) of the terminal receiving portion 24 to complete the assembling of the connector 21 as shown in FIGS. 4 and 5.

Due to closing of the terminal receiving portion 24 by the cover 23, the tapered surfaces 27*a*, 27*a* of the locking projections 27, 27 abut against the auxiliary lock projections 49, 49 to limit the movement of the cover 23. This also enables the terminal 3 to abut against the terminal securing portion 43 to stop the movement of the terminal 3.

Figure 6:
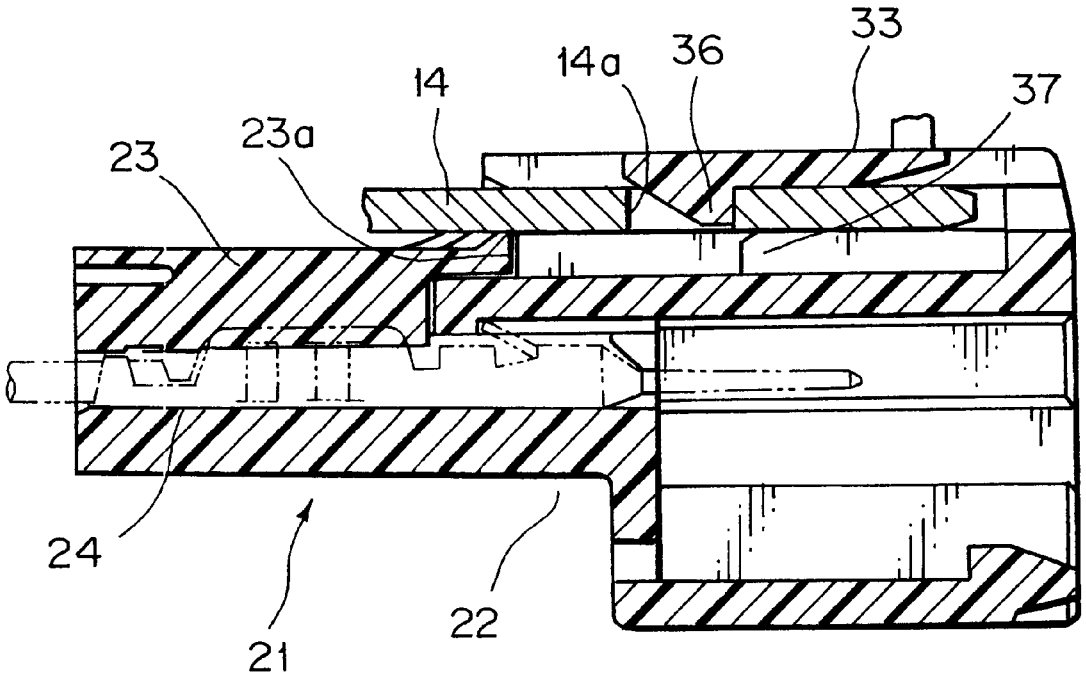
FIG. 6 is a section view showing a state that the connector has been attached to a vehicle side fitting member.
Figure 7:
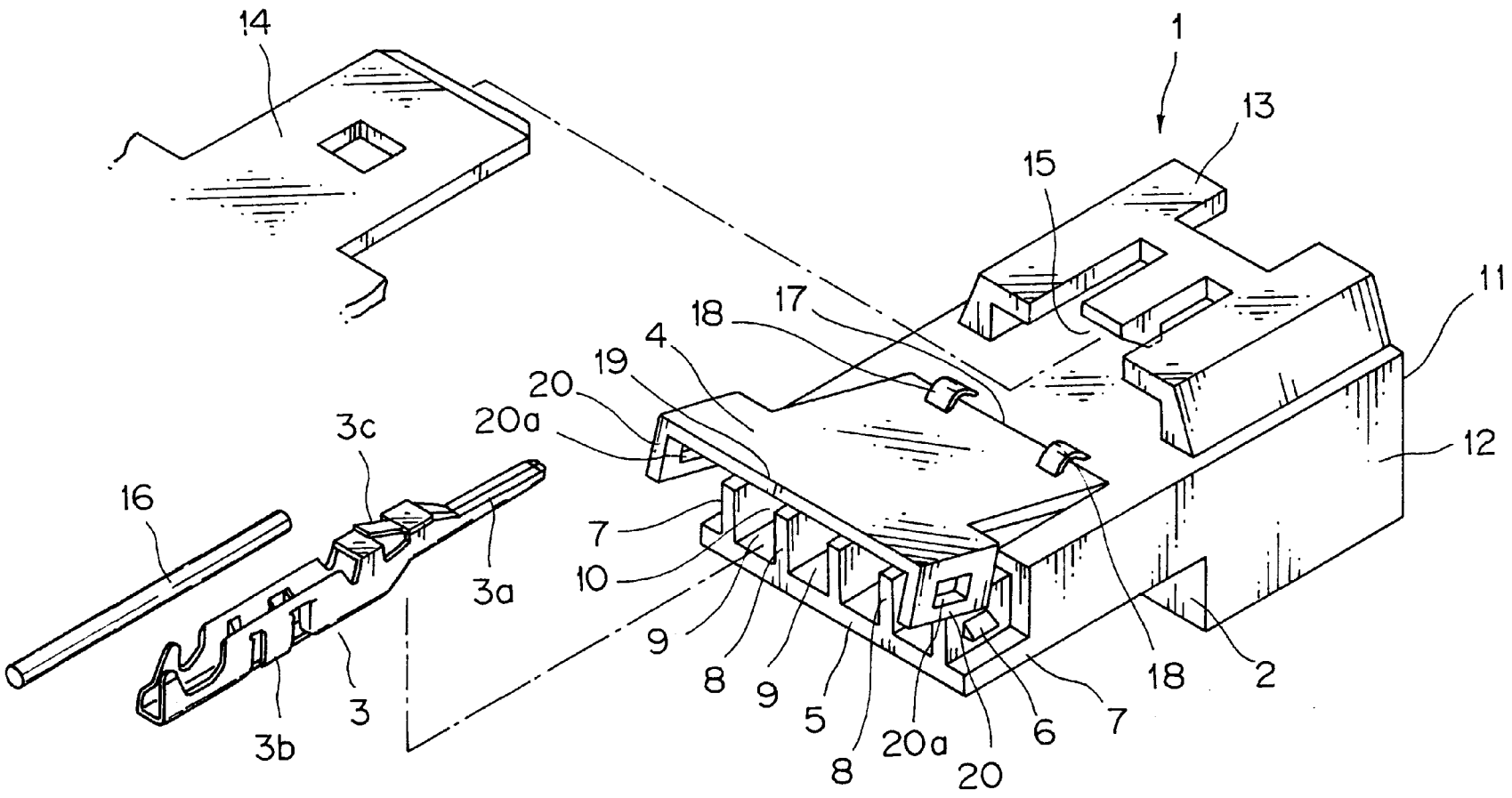
FIG. 7 PRIOR ART
FIG. 7 is an exploded perspective view showing a prior art connector with a cover.

Thus assembled connector 21 is attached to the vehicle side fitting panel 14 as shown in FIG. 6. That is, the panel 14 advances along each side wall 34 (see FIG. 1) into the panel insertion cavity 37, so that the lock protrusion 36 engages with the locking hole 14*a* to complete the mounting of the connector 21.

In addition, the panel 14 abuts against and presses the fore end 23*a* of the cover 23 to further limit the movement of the fore end 23*a*.

As described above, in the connector 21, the cut-out recess 35, 35 provided in the guide wall member 33 receive and engage with the fore end 23*a* of the cover 23. Moreover, the lock hooks 48, 48 near the cover rear end 23*b* engage with the locking projections 27, 27 of the terminal receiving portion 24 so that the cover 23 closes the terminal receiving portion 24. This prevents the fore end 23*a* of the cover 23 from an undesirable lifting of the cover to eliminate the disadvantage described in the prior art so that the cover 23 reliably protects the terminal receiving portion 24.

The fitting panel 14 further press-secures the fore end 23*a* of the cover 23, providing an improved reliable protection of the terminals 3.

Moreover, closing the terminal receiving portion 24 by the cover 23 makes the lock hooks 48, 48 engage with the locking projections 27, 27 so that the auxiliary lock projections 49, 49 abut against the tapered surfaces 27*a*, 27*a* to limit the movement of the cover 23.

In addition, the terminals 3 are secured by the cover 23 that is held both at the fore end 23*a* and at the lock hooks 48, which is preferable in the strength of the cover 23 for securing the terminals 3.

What is claimed is:

1. An electrical connector comprising:

a connector housing having a terminal receiving portion at its rear side and an opposing connector coupling portion at its fore side, said terminal receiving portion including a pair of side walls and a plurality of terminal receiving channels separated by a plurality of partition walls extending in the connector engagement direction between said side walls, said side walls each having a locking projection, said opposing connector coupling portion having a top wall provided with a guide wall member that defines an insertion cavity arranged to receive a vehicle side fitting member, said guide wall member formed with a cut-out recess, a plurality of wire-press-fit-type terminals each received in one of said terminal receiving channels and each fitted with an electrical wire therein, and a cover for said terminal receiving portion, a fore end of said cover attached to said connector housing with a hinge, said cover having a pair of side walls at its rear portion, said side walls each provided with a lock hook that is engaged with one of said locking projections, wherein, said cut-out recess of said guide wall member receives a portion of said fore end of said cover for engagement therewith to prevent lifting of the fore end of the cover and said lock hook of said cover engages with said locking projection of said connector housing when said cover closes the terminal receiving portion.

2. An electrical connector recited in claim 1, wherein the vehicle side fitting member is provided, and said insertion cavity of said connector housing receives said vehicle side fitting member so that said fitting member abuts against said portion of said fore end of said cover to further secure said cover to said connector housing.

3. An electrical connector recited in claim 1, wherein said locking projection of said connector housing has a tapered surface while said lock hook has an auxiliary lock projection opposing to said tapered surface for locking said lock hook of said cover to said connector housing with no gap.

4. An electrical connector recited in claim 1, wherein said cover has a protrusion at said portion of said fore end of said cover which is engaged with said cut-out recess of said guide wall member for abutting against said vehicle side fitting member.

5. An electrical connector recited in claim 1, wherein said cover has an inner wall provided with a terminal securing portion that opposes to said terminal receiving portion.

6. An electrical connector recited in claim 5, wherein said terminal securing portion has a press-securing elongated projection for preventing disengagement of said terminal and for press-securing said electrical wire, and has a press-securing cradle for press-securing a crimped portion of an insulated coated part of said electrical wire.

* * * * *